US009834345B2

(12) United States Patent
Wieder

(10) Patent No.: US 9,834,345 B2
(45) Date of Patent: Dec. 5, 2017

(54) CLOSURE FOR A BOTTLE

(71) Applicant: Manuel Wieder, Zell am See (AT)

(72) Inventor: Manuel Wieder, Zell am See (AT)

( * ) Notice: Subject to any disclaimer, the term of this patent is extended or adjusted under 35 U.S.C. 154(b) by 30 days.

(21) Appl. No.: 14/937,057

(22) Filed: Nov. 10, 2015

(65) Prior Publication Data

US 2016/0137363 A1 May 19, 2016

(30) Foreign Application Priority Data

Nov. 13, 2014 (AT) ..... A 821/2014

(51) Int. Cl.

| | |
|---|---|
| ***B65D 51/16*** | (2006.01) |
| ***B65D 47/06*** | (2006.01) |
| ***B65D 47/12*** | (2006.01) |
| ***B65D 47/32*** | (2006.01) |
| ***A47G 19/22*** | (2006.01) |

(52) U.S. Cl.

CPC ..... *B65D 51/1644* (2013.01); *A47G 19/2266* (2013.01); *B65D 47/06* (2013.01); *B65D 47/121* (2013.01); *B65D 47/32* (2013.01)

(58) Field of Classification Search

CPC .. B65D 51/1644; B65D 47/32; B65D 47/121; B65D 47/06; A47G 19/2266

USPC ..... 215/311, 307, 314, 316; 220/254.1, 220/254.8, 254.9, 580, 202, 203.01, 220/203.06, 203.11, 203.27, 203.29, 227, 220/271, 303, 360, 366.1, 367.1; 222/260, 189.09

See application file for complete search history.

(56) References Cited

U.S. PATENT DOCUMENTS

| | | | | |
|---|---|---|---|---|
| 5,988,448 | A * | 11/1999 | Foth | B65D 47/243 222/189.09 |
| 6,257,453 | B1 * | 7/2001 | Graham | B65D 41/3447 215/253 |
| 6,305,570 | B1 | 10/2001 | Atkin et al. | |
| 6,491,175 | B1 * | 12/2002 | Taha | B29C 45/262 215/252 |

(Continued)

FOREIGN PATENT DOCUMENTS

| | | |
|---|---|---|
| AT | 509 897 | 12/2011 |
| DE | 90 05 488 | 10/1991 |

(Continued)

OTHER PUBLICATIONS

European Search Report dated Mar. 17, 2016 in corresponding European Application No. 15003165 (with English translation).

*Primary Examiner* — Kareen Thomas

(74) *Attorney, Agent, or Firm* — Wenderoth, Lind & Ponack, L.L.P.

(57) ABSTRACT

A closure for a drinking bottle includes a closure cap for fixing the closure to a drinking bottle. The closure cap has a through hole and at least one ventilation opening, and a seal arranged in the closure cap. Either the seal or the closure cap has a web, by which the seal and the closure cap are at least in contact section-wise. The seal is of such a configuration that, upon the occurrence of an increased or reduced pressure in the bottle and/or by axial displacement of the seal in the closure cap, at least a section of the seal that is between the web and an inside wall of the closure cap lifts off the inside wall of the closure cap and thus opens a gap for ventilation of the drinking bottle by the at least one ventilation opening.

7 Claims, 10 Drawing Sheets

(56) References Cited

U.S. PATENT DOCUMENTS

| | | | | |
|---|---|---|---|---|
| 6,508,379 | B1 | 1/2003 | Van De Pol-Klein Nagelvoort et al. | |
| 7,503,453 | B2 * | 3/2009 | Cronin | B65D 47/243 206/221 |
| 7,726,506 | B2 * | 6/2010 | Reutter | B65D 51/16 220/203.12 |
| 8,820,554 | B2 * | 9/2014 | Rho | B65D 51/224 215/253 |
| 9,067,716 | B2 * | 6/2015 | Cronin | B65D 51/2864 |
| 2002/0066714 | A1 * | 6/2002 | Mainquist | B65D 51/1633 215/261 |
| 2002/0121531 | A1 | 9/2002 | Stillinger et al. | |
| 2003/0034364 | A1 | 2/2003 | Mugge | |
| 2007/0007231 | A1 * | 1/2007 | Naesje | B65D 47/2081 215/311 |
| 2009/0302073 | A1 | 12/2009 | McKeown | |
| 2012/0273521 | A1 * | 11/2012 | Wu | B65D 47/283 222/153.14 |
| 2015/0265079 | A1 | 9/2015 | Kamping et al. | |

FOREIGN PATENT DOCUMENTS

| | | |
|---|---|---|
| DE | 297 05 178 | 8/1997 |
| DE | 20 2010 015 802 | 3/2011 |
| EP | 0 881 155 | 12/1998 |
| EP | 2 130 472 | 12/2009 |
| EP | 2 457 842 | 5/2012 |
| WO | 99/38423 | 8/1999 |
| WO | 2014/086625 | 6/2014 |

* cited by examiner 1
9
12
13
14
4

1

A
A
4
13

DETAIL B
17
4
18

SECTION A–A
B
12
13
14
4

CLOSURE FOR A BOTTLE

BACKGROUND OF THE INVENTION

1. Field of the Invention

The invention concerns a closure for drinking bottles.

2. Description of Related Art

Closures for drinking bottles are known in many different kinds from the state of the art. For example, AT 509 897 describes a hand-screwed closure for drinking bottles, wherein the hand-screwed closure has a through hole in which a seal which can receive a drinking straw can be releasably fixed. AT 509 897 describes two openings in the closure cap which are intended to prevent the occurrence of reduced pressure in the drinking bottle during the drinking process. For that purpose, provided in a seal are venting slots, the positions of which, in the condition of being screwed to the bottle, must correspond to the venting openings. Accordingly, the seal has a positioning device so that the venting slots in the seal can be arranged in the correct positions with respect to the venting openings in the closure cap when the closure is screwed to the drinking bottle. Such venting slots are also not optimum from a hygiene point of view as they cannot be cleaned well.

SUMMARY OF THE INVENTION

The object of the present invention is to provide a closure which is improved over the state of the art, and a drinking bottle.

Advantageous embodiments are recited in the appendant claims.

By virtue of the fact that either the seal or the closure cap has a web, by way of which the seal and the closure cap are at least section-wise in contact, wherein the seal is of such a configuration that, upon the occurrence of an increased or reduced pressure in the bottle and/or by axial displacement of the seal in the closure cap, at least that section of the seal that is between the web and an inside wall of the closure cap lifts off the inside wall of the closure cap and thus opens a gap for ventilation of the drinking bottle by way of the at least one ventilation opening, it is possible to relieve an increased or reduced pressure in the drinking bottle.

The space inside the drinking bottle therefore communicates with the environment through the opened gap by way of the at least one ventilation opening and is thus restored to the ambient pressure. The section of the seal between the web and the inside wall of the closure cap is the part which projects from the web outwardly, that is to say in the direction of the periphery.

The particular advantage of the proposed solution over the state of the art is that venting is accomplished without a perforation in the seal. Thus, the disadvantages of venting slots in the seal noted in the description of related art section above are avoided.

It is preferably provided that the seal has a tipping point. This means that the seal bears against the web in such a way that, under the action of an increased pressure in the bottle, the sealing section between the web and the inside wall of the closure cap tips open in opposite relationship to the direction in which the increased pressure acts.

Technically, that is achieved in such a way that the membrane seal, made for example from silicone, in the installed condition has a prestressing and thus a so-called return flex. Return flex means that the membrane tends to return to the non-deformed position.

The tipping of the sealing section between the web and the inside wall of the closure cap opens a gap between the seal and the inside wall. By virtue of the fact that the seal is of such a design configuration that it has a tipping point, the venting action, that is to say relief of an increased pressure from the bottle, occurs not gradually but abruptly only when a given magnitude of the increased pressure is achieved. Adjustment of the tipping point is effected by way of tests or simulation, wherein the essential influencing parameters are the stiffness of the seal and the lever spacing of the seal on the sealing spacing between the web and the inside wall of the closure cap. The parameters are selected such that the tipping point is reliably reached in the event of an increased pressure which is usually to be expected in a drinking bottle.

It can preferably be provided that the seal with the web and the inside wall of the closure cap form a gap space, wherein the gap space communicates with the environment by way of at least one ventilation opening.

It is preferably provided that the seal is, at least section-wise, in the form of a membrane-like section. In other words, the seal is, at least section-wise, of a thin-walled and planar configuration.

It can preferably be provided that the membrane-like section forms a segment of a circle extending over 360° or a circular ring extending over 360°. That means that the membrane-like section extends over the entire periphery of the seal. The term sector of a circle (segment of a circle) is used to denote a part of a circular surface delimited by a circular arc and two radii of the circle. The term circular ring is used to denote the area between two concentric circles, that is to say, the area between two circles with a common center point.

Alternatively, it can be provided that the membrane-like section forms a segment of a circle or a circular ring under 360°. This means that the membrane-like section can also extend only over a segment of a full circle, therefore less than 360°.

The web can be of a continuous peripheral configuration. Alternatively, the web can also be interrupted.

The seal can also be of a peripherally closed or interrupted configuration, that is to say, the seal can be formed in segments.

The web can be provided on the seal or on the closure cap. In both cases, the web can be of a peripheral configuration or interrupted.

It is preferably provided that the web is provided in the region of the membrane-like section. In the case in which the web is part of the seal, this means that the web is in the form of a raised part in the membrane-like section.

In the case where the web forms a part of the closure cap, this means that the web is provided on the level of the membrane-like section.

BRIEF DESCRIPTION OF THE DRAWINGS

The invention is described in greater detail hereinafter with reference to the drawings in which.

DETAILED DESCRIPTION OF THE INVENTION

Figure 1:
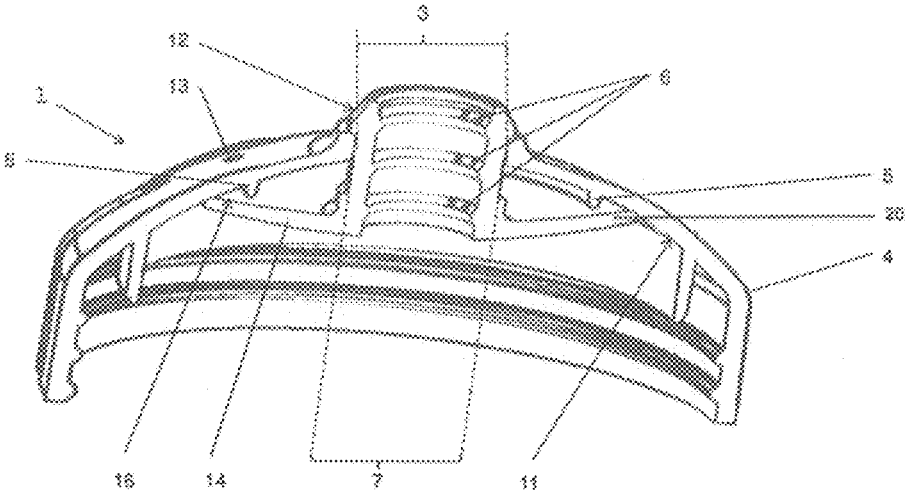
FIG. 1 shows a perspective view in cross section of the closure.

FIG. 1 shows a first embodiment of the closure 1 as a section in a perspective view.

In this case, the seal 12 is made from a flexible material, for example, rubber or silicone, and seals off the closure cap 4 relative to the through hole 3 in the closure cap 4. In this case, the seal 12 is section-wise of a membrane-like configuration, being therefore of a planar configuration (in the membrane-like section 14). The geometrical configuration of the membrane-like section 14 is that of a circular ring which in this embodiment extends over 360°, therefore around the entire periphery of the seal 12. Shapes differing from the ideal configuration of a circular ring for the membrane-like section 14 can also be envisaged.

In addition, the seal 12 has a substantially cylindrically shaped section 7 which is fitted like a kind of plug into the passage hole 3 in the closure cap. Thus, at the same time as the sealing function described hereinafter, the seal 12 also forms the mouthpiece for drinking or a receiving means for a drinking straw. For the sake of simplicity, the section 7 is identified as a cylindrical section and can naturally depart from an ideally cylindrical configuration. The cylindrical section 7 of the seal has a through hole and can be seen as hollow cylinder.

The seal 12 does not necessarily have to be formed in one piece. Thus, the cylindrical section 7 and the membrane-like section 14 of the seal can be parts which are produced separately and subsequently joined.

In the present embodiment, the seal 12 bears against the inside wall 11 of the closure cap 4 over the entire periphery of the membrane-like section 14, that is to say, in continuously peripheral relationship. The seal 12 bears snugly against the inside wall.

Figure 5:
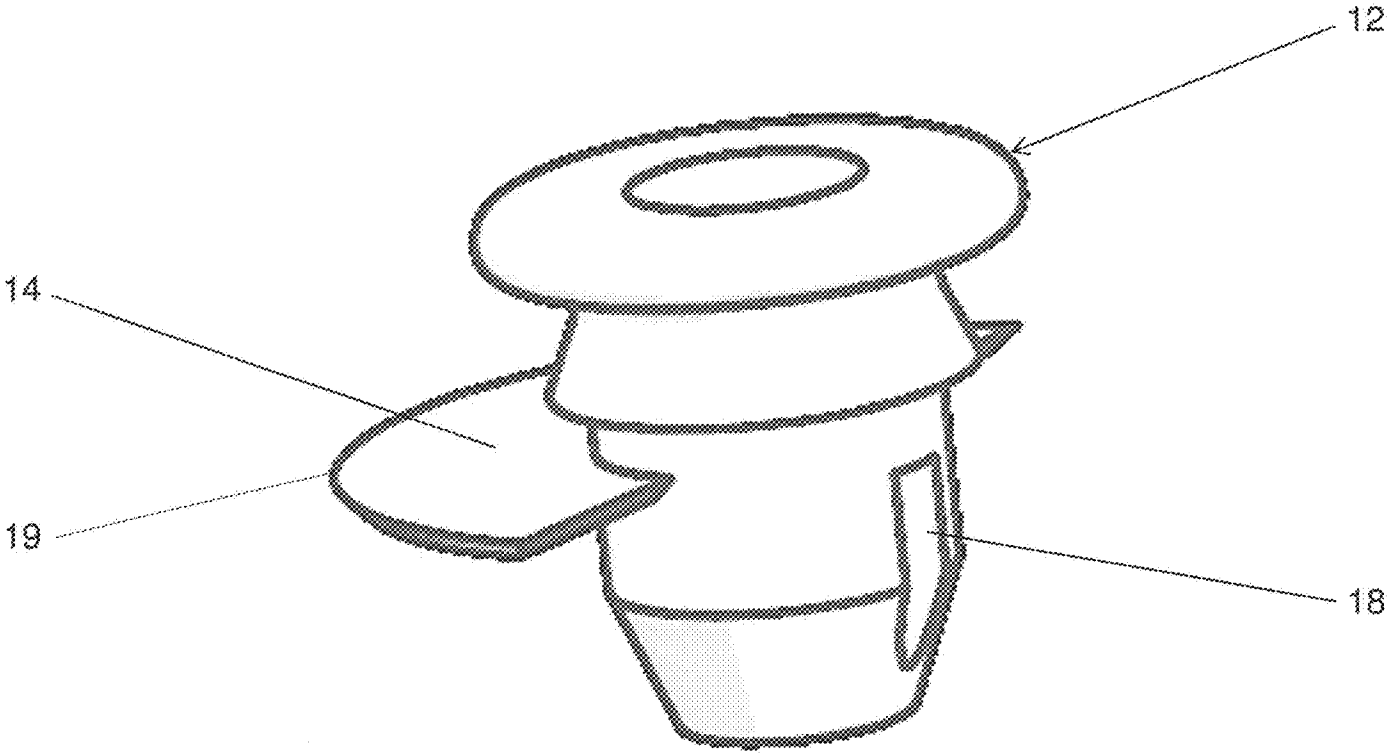
FIG. 5 shows a seal according to a further embodiment.

Unlike the configuration shown here, the membrane-like section 14 could also be in the form of a segment of a circle, that is to say not extending over 360°, as shown, for example, in the embodiment of FIG. 5.

At the same time, the seal 12 bears at least section-wise against the web 5 which is formed as a projecting rib on the inside wall 11 of the closure cap 4. When the transport closure 8 (not shown here for the sake of clarity of the drawing) is inserted, a container (not shown) which is closed with the closure 1 is sealingly closed by the seal 12 bearing against the inside wall 11 of the closure cap 4.

The seal 12 is of such a configuration that the inside wall of the cylindrical section 7 of the seal can serve for receiving a transport closure 8 (not shown) or a drinking straw 9 (also not shown). Preferably, provided for that purpose on the inside of a through passage formed in the cylindrical section 7 of the seal are latching means 6 which can securely fix a transport closure 8 or a drinking straw 9. Basically, other measures with which a person skilled in the art is familiar can also be considered, for designing the cylindrical section 7 of the seal such that drinking straws of different diameters can be securely held. Thus, for example, the inside diameter of the cylindrical section 7 of the seal can be of a conically downwardly narrowing configuration (in the direction of the interior of the closure cap).

As a particularly suitable dimension, it has been found that the inside diameter of the cylindrical section 7 of the seal can converge from 7 millimeters at the outside (from where therefore a drinking straw is introduced) to 5 millimeters (at the lower end of the cylindrical section 7 of the seal). In that way, typical commercial drinking straws are held firmly and in securely leakage-free fashion.

In its fixing situation in the closure cap 4, the seal 12 is fitted into the through hole 3 in the closure cap 4. The material of the seal 12 is selected to be sufficiently flexible so that the cylindrical section 7 of the seal including the shoulder 17 can be pressed from the inside outwardly through the through hole 3 in the closure cap 4. In the fixing situation, the membrane-like section 14 is urged at its periphery against the inside wall 11 of the closure cap 4.

For adjusting the pressing force required for a sealing action, the membrane-like section 14 is preferably pre-shaped in a dish-like configuration upwardly, in the unloaded condition. As the seal 12 in the installed condition bears with the shoulder 17 against the outside of the through hole 3, that provides for stressing of the membrane-like section 14 with respect to the inside wall 11 whereby the membrane-like section 14 is pressed at its periphery against the inside wall 11.

If now the internal pressure in the container closed by the closure 1 increases, for example, due to warming or when gas issues from carbonized drinks, the internal pressure in the container thus acts on the membrane-like section 14 of the seal 12.

The position of the web 5 and the membrane-like section 14 relative to each other is selected such that the part of the membrane-like section 14, that faces inwardly from the web 5, is markedly larger than the projecting part protruding outwardly from the web 5. By virtue of the larger area with which the internal pressure acts on that part of the membrane-like section 14, that faces inwardly from the web 5, that section moves upwardly in the direction of the through hole 3.

Due to the lever action at the web 5 which acts as a support, the projecting part of the membrane-like section 14, that protrudes outwardly from the web 5, moves downwardly in opposite relationship to the direction in which the internal pressure acts and lifts off the inside wall 11. When a certain internal pressure is exceeded, therefore the material section projecting between the web 5 and the inside wall 11 tips open and thus opens a gap 21 between the inside wall 11 and the seal 12.

The movement of the membrane-like section 14 is made possible by a suitable flexibility of material in the lower region of the cylindrical section 7 of the seal and/or by axial displacement of the seal 12 in the through hole. It is therefore entirely possible that actuation of the seal is effected exclusively by deformation of the membrane-like section 14 and the adjoining regions of the cylindrical section 7 of the seal. Likewise, deformation of the membrane-like section 14 can be accompanied by an axial displacement of the cylindrical section 7 of the seal.

A person skilled in the art can deduce the precise geometrical relationships by way of material characteristic values and can fix them by way of extrusion tests. The geometries shown in FIGS. 1 through 4 reproduce relationships which are suitable for typical commercial wide-neck drinking bottles.

The gas can now escape and thus the increased pressure in the container can be relieved through the ventilation opening 13 which is disposed in the closure cap 4 in a section which is between the web 5 and the sealing surface formed by the seal 12 relative to the inside wall.

The web 5, a section of the inside wall 11 and that section 20 of the seal 12 that is between the web 5 and the inside wall 11 therefore forms a gap space 16. The ventilation openings 13 communicate the gap space 16 with the environment. Pressure equalization is effected in a particularly convenient and elegant fashion by the described tipping effect of the seal 12.

A further advantage of this embodiment over the state of the art is that installation of the seal 12 in a correct position is not necessary. This means that the seal 12 can be fitted in any desired angular position.

Pressure equalization also functions in the reverse fashion if the outside pressure exceeds the inside pressure, as can occur for example due to cooling of the contents of a bottle, due to an increase in altitude or when drinking. Here, venting is effected by the outside pressure urging the projecting part of the membrane-like section 14 of the seal between the web 5 and the inside wall 11 downwardly. In that way, the seal 12 also lifts away from the inside wall 11 and pressure equalization can take place.

Figure 2:
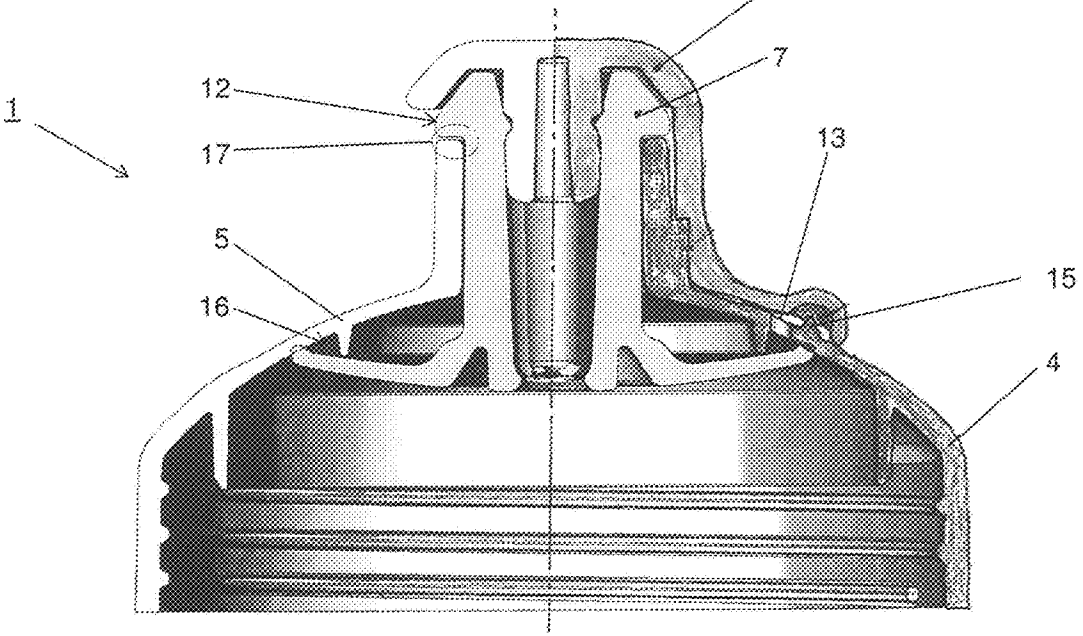
FIG. 2 shows a cross section of the closure with transport stopper.

FIG. 2 shows a cross-sectional view of a closure 1, wherein a transport closure 8 is fitted into the seal 12. It is possible to clearly see the web 5 at which the seal 12 is supported and the gap space 16 formed with the inside wall.

Other solutions for closing a drink container closed by means of the closure 1 can also be considered. Mention may be made, for example, of the possibility of fitting the closure 1 onto a drink container which is closed with an original seal. An original seal is usually a thin polymer film which hygienically closes the content of a disposable container. In that case, a drinking straw can be pushed through the closure 1 and through the original seal.

In the illustrated embodiment, the transport closure 8 is of such a configuration that ventilation openings 13 are overlapped by the transport closure 8. For that purpose, provided on the outside wall of the closure cap 4, is a latching means 15 into which the transport closure 8 can latchingly engage.

The closure 1 affords a leakage prevention means in the case of a bottle 10 being tipped over as well as improved handling in the case of using the closure 1 with a drinking straw 9.

When using a drinking straw 9, the seal 12 provides that a reduced pressure, which is built up in the bottle 10, is compensated for relative to the ambient pressure by way of the effect, described in the opening part of this specification, of the seal 12.

The configuration according to the invention of the closure 1 also prevents an increased pressure from being able to build up in the bottle 10, which would result in an unwanted escape of liquid by way of the drinking straw 9. The configuration according to the invention of the closure 1 also prevents deformation of the drinking bottle 10 due to pressure differences.

Figure 3:
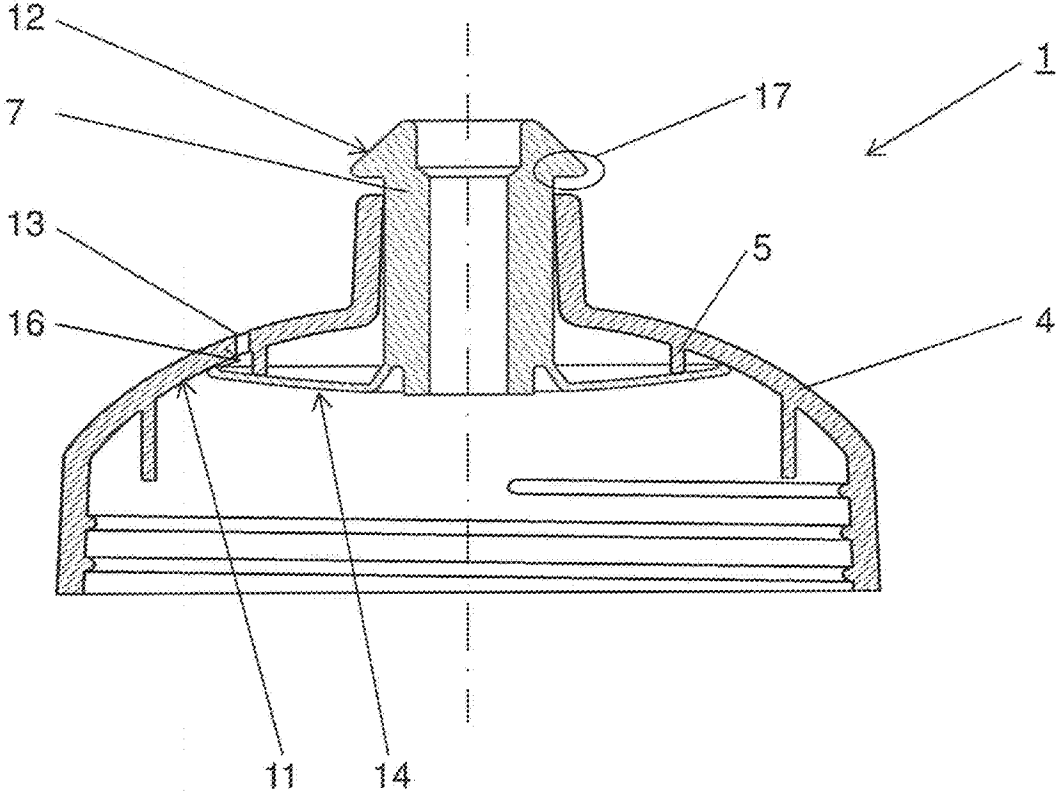
FIG. 3 shows a cross section of the closure with closed seal.

FIG. 3 shows a cross section of the closure 1 with the seal 12 closed. It can be clearly seen once again that the membrane-like section 14 of the seal 12 seals off the gap space 16. As described hereinbefore, an increased pressure in the drinking bottle 10 (not shown) causes deformation of the membrane-like section 14 in such a way that it tips open and opens the gap space 16 relative to the drinking bottle 10. In that way, pressure equalization can occur by way of the ventilation opening or openings 13. Conversely, a reduced pressure in the drinking bottle 10 can also cause opening of the gap space 16 relative to the drinking bottle 10.

Figure 4:
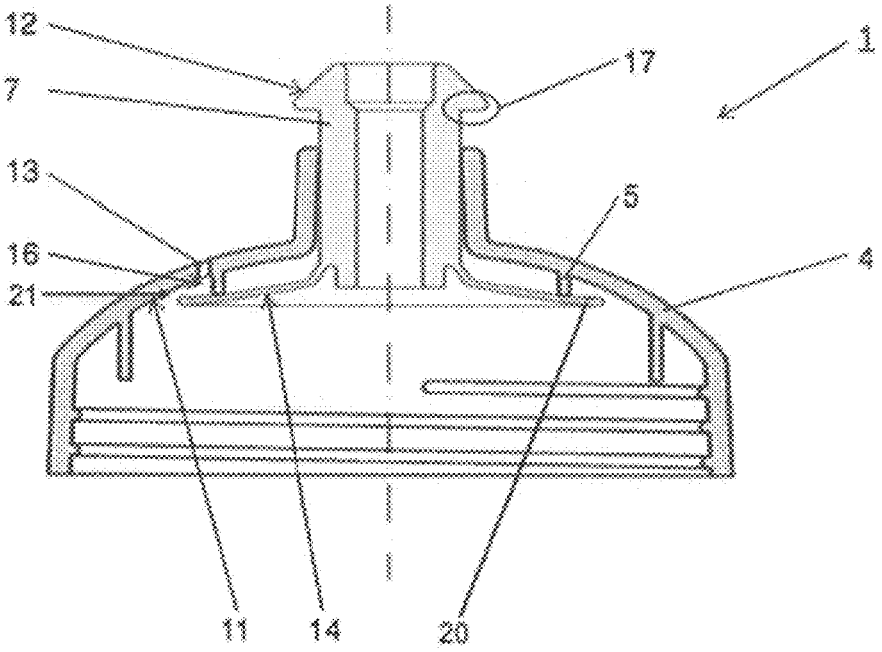
FIG. 4 shows a cross section of the closure with opened seal.

FIG. 4 shows a cross section of the closure 1 with seal 12 in the opened position. The membrane-like section 14 of the seal 12 is lifted off the inside wall 11. The gap space 16 is opened with respect to the interior of the closure web 4. It can further be seen that the cylindrical section 7 of the seal 12 is displaced somewhat axially upwardly in the through hole 3. In this embodiment, opening of the seal 12, that is to say the lifting-off of the membrane-like section 14 from the inside wall 11, is accompanied by a movement of the cylindrical section. As already explained, the opening process can be implemented by an increased pressure in the bottle 10. The seal 12 can also be moved into an opened position by pulling on the cylindrical section 7 of the seal.

In a variant which is not shown here, the cylindrical section 7 of the seal could be provided at its outside diameter with latching means or the like so that the seal 12 can be fixed in an opened position by the user.

It is in no way necessarily required for all variants of the closure 1 that the cylindrical section 7 of the seal moves in the through hole for opening of the seal. It is also possible, for example, to ensure an opening tipping movement as already described and thus opening of the seal 12, by a weakening, that is to say, by a particularly flexurally soft configuration of the lower region of the cylindrical section 7 of the seal. By allowing such an upsetting region in the cylindrical section 7 of the seal, opening of the seal 12 does not unconditionally have to be seen from the outside.

FIG. 5 shows a further embodiment of a seal 12.

Here, the membrane-like section of the seal 12 is only of a segmental configuration. The membrane-like section 14 of the seal therefore does not extend over 360° of the seal 12. Here, the seal 12 carries a positioning device 18 in the form of a groove or recess. The positioning device 18 serves for guiding the seal 12 in a closure cap 4 and for positioning the seal 12 at the correct angle. If the membrane-like section 14 is incomplete over the periphery as shown in this embodiment, then installation of the seal 12 in the closure cap 4 in the correct angular position is relevant. The corresponding counterpart section of the positioning device 18 can be provided in the closure cap 4. In this case, the counterpart section would be a projection, for example, a knob or a rib.

The membrane-like section 14 of the seal can have a web 5 (not shown here) on which the membrane-like section 14 is in line contact with the closure cap 4 similarly to the web 5 of the preceding embodiment (in which the web 5 was in the form of part of the closure cap 4). The above-described tipping effect is made possible by the web 5. It is irrelevant for that purpose whether the web 5 is on the closure cap 4 or on the seal 12.

For a particularly good sealing action, a ridge 19 can be provided at the periphery of the membrane-like section 14 of the seal 12, by which ridge the seal 12 then bears in a defined condition against the inside wall 11 of the closure cap 4. Such a ridge—a fine raised section is sufficient—is desirable in particular when the seal 12 does not have any prestressing or only a slight degree of prestressing relative to the closure cap 4. The ridge 12 is in no way essential.

This embodiment is particularly suited to closure caps 4 with a substantially flat cover surface, that is to say, closure caps which do not involve a dome shape. That shape is frequently to be encountered in the case of typical commercial wide-neck polyethylene terephthalate (PET) disposable bottles. With the closure 1 in accordance with this embodiment, specified bottles become practical sports drink bottles.

Figures 6A, 6B, 6C:
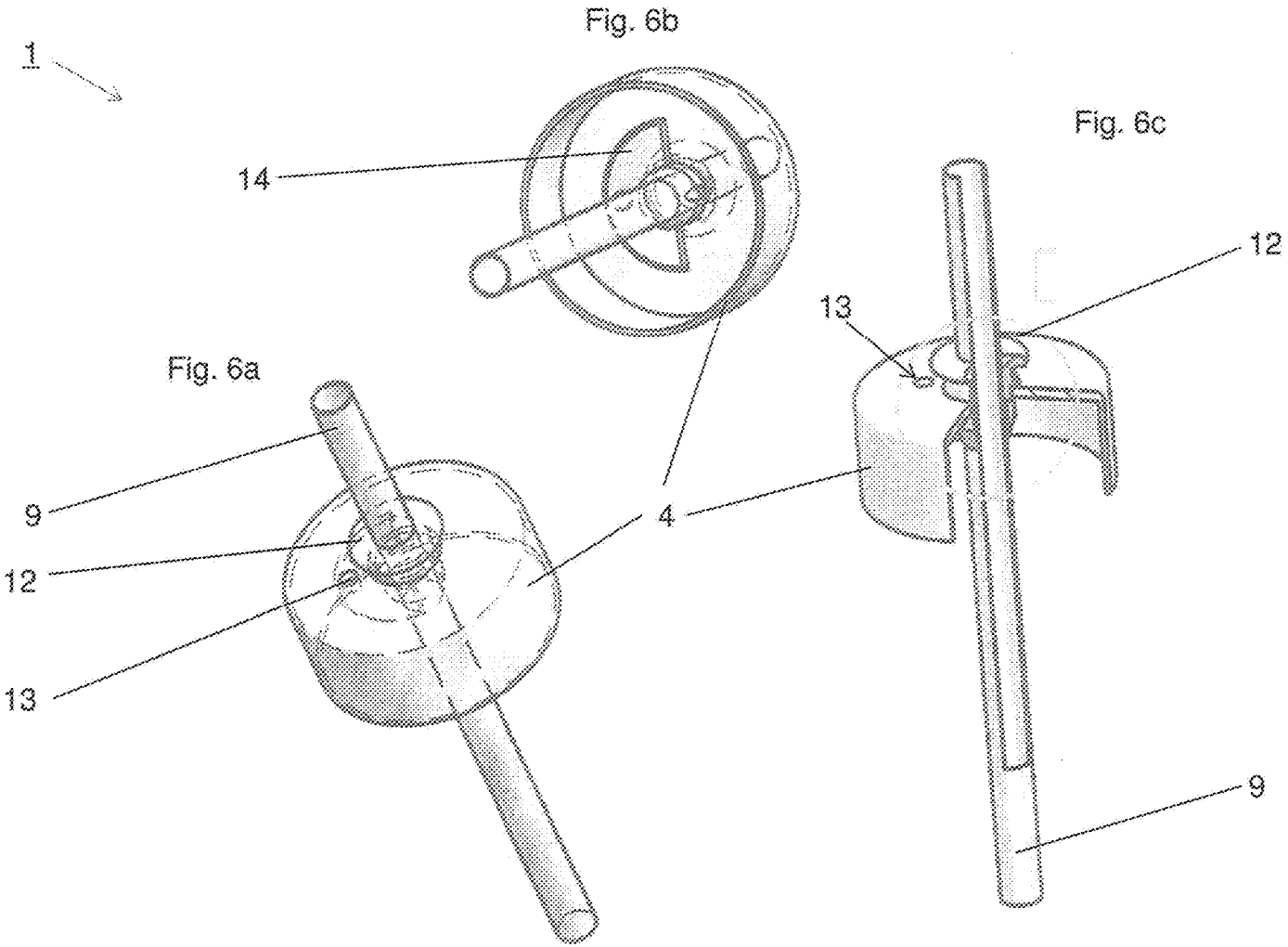
FIGS. 6*a*-6*c* show various views of an arrangement of seal and closure cap.

FIGS. 6*a* through 6*c* show views of a closure cap 4 with the seal 12 according to the embodiment of FIG. 5. The same arrangement is shown in various respective views.

In this respect, FIG. 6*a* shows a perspective view of the closure cap 4 with the seal 12 with a fitted drinking straw 9.

FIG. 6*b* shows a view from below the position of the membrane-like section 14 of the seal. The membrane-like section 14 of the seal is disposed such that it covers the ventilation opening 13. The operating principle of the seal 12 is the same as described for other embodiments.

In the FIG. 6*c* view, a quadrant is sectioned for more easily seeing the installation section of the seal 12.

FIGS. 7*a* through 7*d* show details of the arrangement of the closure cap 4 with seal 12 in accordance with the embodiment of FIG. 5.

Figures 7A, 7B, 7C, 7D:
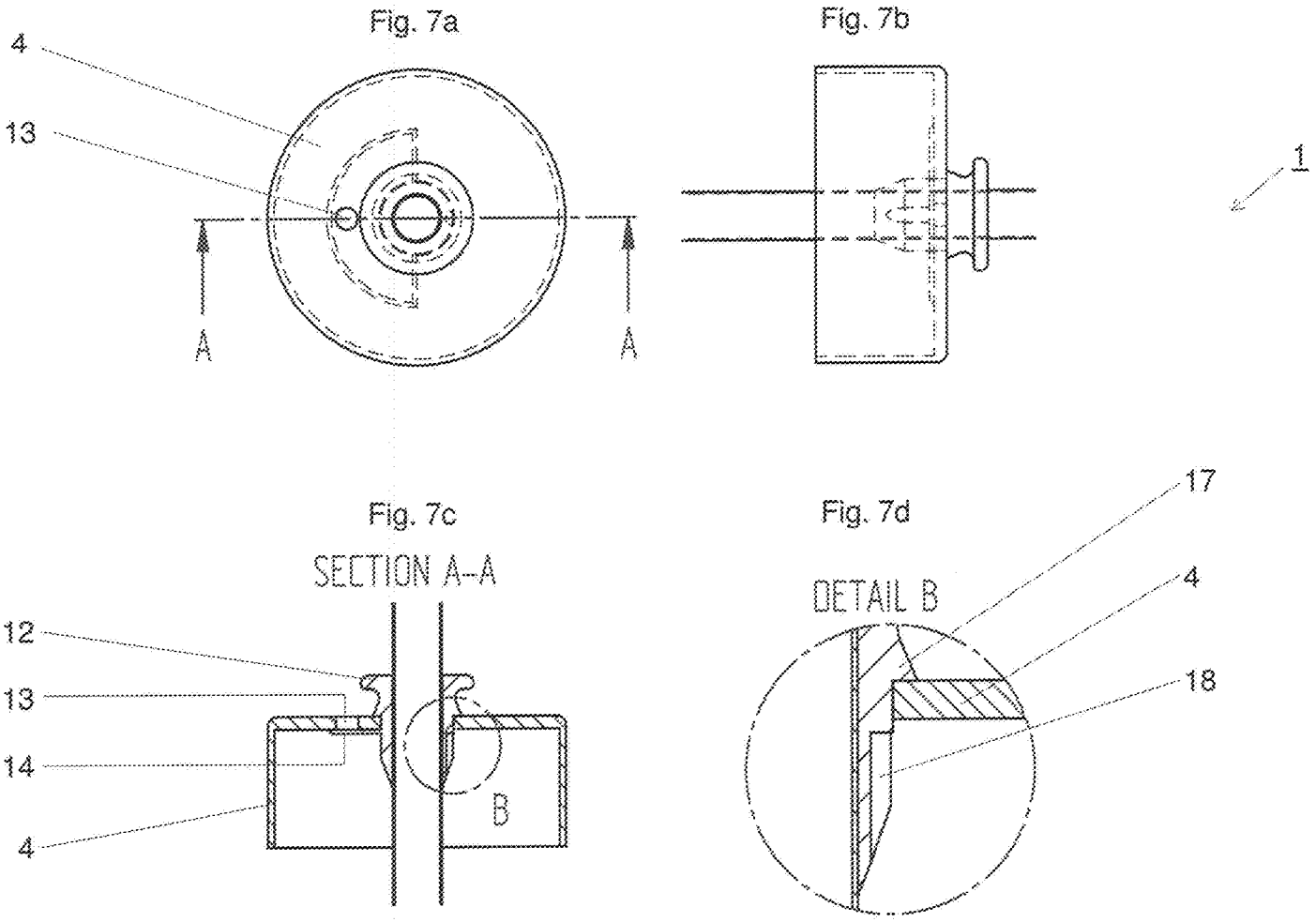
FIGS. 7*a*-7*d* show details of the arrangement of closure cap and seal.

FIG. 7*a* shows a plan view of the closure cap 4 with seal 12 in accordance with the embodiment of FIG. 5.

FIG. 7*b* shows a side view of the same arrangement.

FIG. 7*c* shows the section along line A-A in FIG. 7*a*. The membrane-like section 14 of the seal covers the ventilation opening 13. If now the seal 12 is pushed or pulled upwardly, then the membrane-like section 14 of the seal tips open and opens the ventilation opening 13.

FIG. 7*d* shows Detail B from FIG. 7*c*. The seal 12 sits with a shoulder 17 on the closure cap 4. The positioning device 18 can further be seen.

For all embodiments, the tipping effect is made possible by the web 5. In that respect, it is immaterial whether the web 5 is on the closure cap 4 or on the seal 12.

Figure 8:
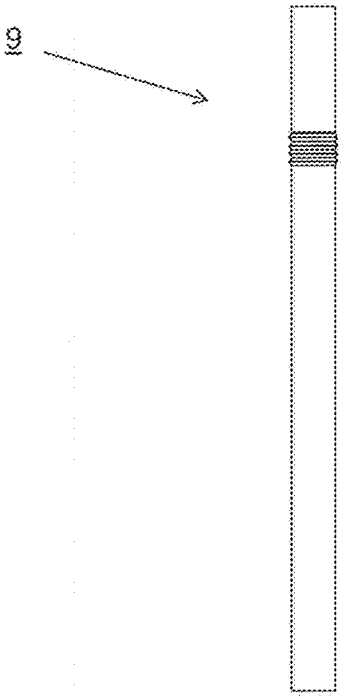
FIG. 8 shows a drinking straw.

FIG. 8 shows a drinking straw 9, here using the example of a bendy straw.

Figure 9:
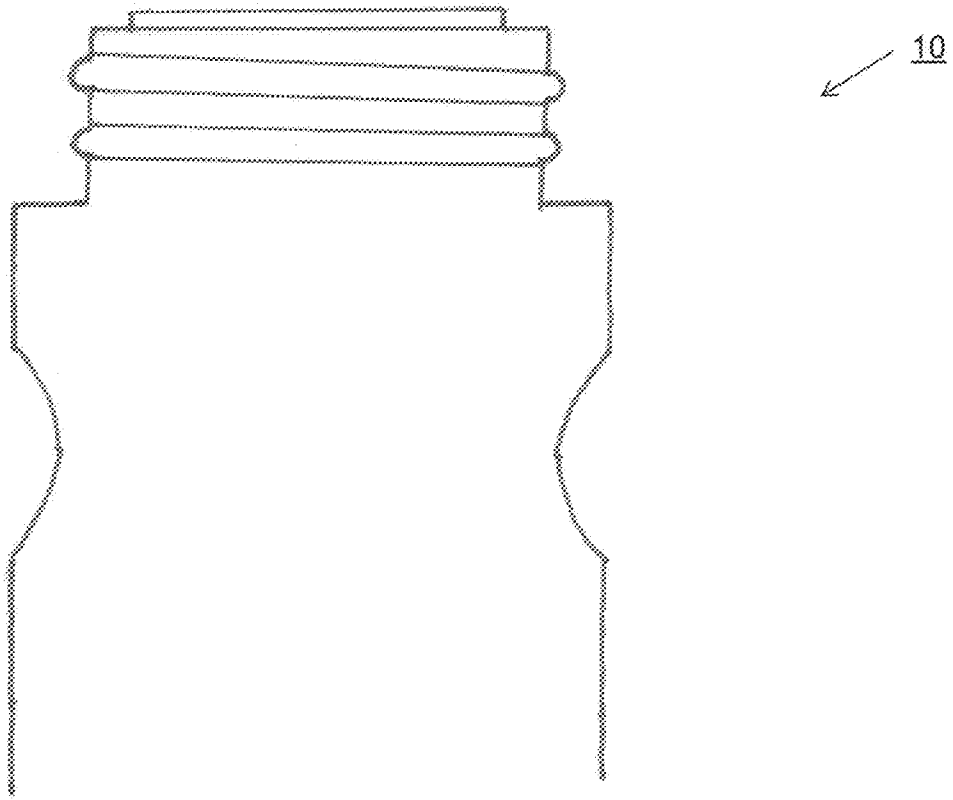
FIG. 9 shows a drinking bottle.

FIG. 9 shows a drinking bottle 10. Only the upper part of the drinking bottle 10, that is relevant in connection with the present application, is shown. The drinking bottle 10 is suitable for being closed with the closure 1. As indicated in FIG. 9, that can be effected, for example, by way of a thread.

When using a drinking straw 9, the closure 1 according to the invention also affords leakage protection, for example, if the drinking bottle 10 is tipped over. Drinking straws having an inside diameter of less than about 8 millimeters are particularly suitable. Then, the capillary forces between the liquid and the drinking straw provide that no liquid runs outwardly through the drinking straw 9 from the drinking bottle 10. The column of liquid in the drinking straw 9 prevents air from subsequently flowing into the drinking bottle 10, which however would be necessary for liquid to escape.

Figure 10:
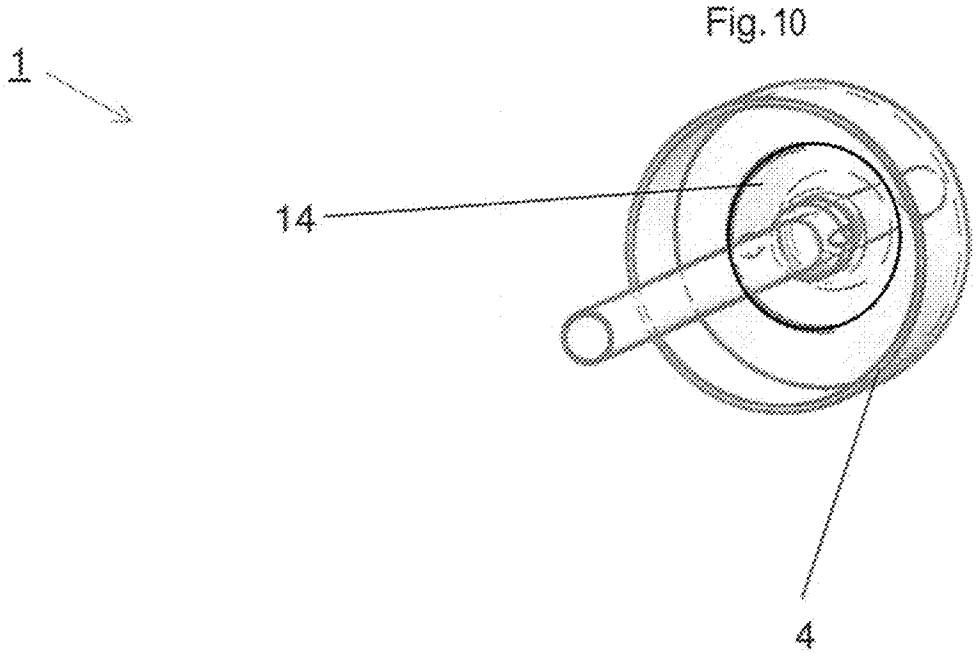
FIG. 10 shows a view of an arrangement of seal and closure cap.

FIG. 10 shows a view from below the position of the membrane-like section 14 of the seal. The membrane-like section 14 of the seal forms a segment of a circle extending over 360° or a circular ring extending over 360°. The operating principle of the seal 12 is the same as described for other embodiments.

LIST OF REFERENCES USED

1 closure
3 through hole
4 closure cap
5 web
6 latching means
7 cylindrical section of the seal 12
8 transport closure
9 drinking straw
10 drinking bottle
11 inside wall of the closure cap 4
12 seal
13 ventilation opening
14 membrane-like section of the seal 12
15 latching means
16 gap space
17 shoulder on the seal 12
18 positioning device
19 ridge
20 section of the seal 12 between the web 5 and the inside wall 11 of the closure 1
21 gap

The invention claimed is:

1. A closure for a drinking bottle, the closure comprising:

a closure cap for fixing the closure to a drinking bottle, wherein the closure cap has a through hole and at least one ventilation opening, and a seal arranged in the closure cap, wherein, either the seal or the closure cap has a web, by which the seal and the closure cap are at least in contact section-wise, wherein the seal is of such a configuration that, upon occurrence of an increased or reduced pressure in the drinking bottle and/or by axial displacement of the seal in the closure cap, at least a section of the seal that is between the web and an inside wall of the closure cap lifts off the inside wall of the closure cap and thus opens a gap for ventilation of the drinking bottle by the at least one ventilation opening, and wherein the seal has a tipping point and bears against the web in such a way that, upon development of the increased pressure in the drinking bottle, a sealing section between the web and the inside wall of the closure cap tips open in opposite relation to an active direction of the increased pressure and thus opens the gap for ventilation of the drinking bottle by the at least one ventilation opening.

2. The closure of claim 1, wherein the seal at least section-wise includes a membrane section.

3. The closure of claim 2, wherein the membrane section defines a segment of a circle extending over 360° or a circular ring extending over 360°.

4. The closure of claim 1, wherein the web extends peripherally.

5. The closure of claim 1, wherein the web is interrupted.

6. A drinking bottle having the closure of claim 1.

7. An arrangement having a drinking bottle, a drinking straw and the closure of claim 1.

* * * * *